US006597386B2

(12) United States Patent
Sato

(10) Patent No.: US 6,597,386 B2
(45) Date of Patent: Jul. 22, 2003

(54) LINE THERMAL PRINTER AND ENERGIZATION CONTROLLING METHOD

(75) Inventor: Masanori Sato, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 37 days.

(21) Appl. No.: 09/888,900

(22) Filed: Jun. 25, 2001

(65) Prior Publication Data

US 2001/0055057 A1 Dec. 27, 2001

(30) Foreign Application Priority Data

Jun. 26, 2000 (JP) ..... 2000-191000

(51) Int. Cl.[7] ..... B41J 2/36; B41J 2/365
(52) U.S. Cl. ..... 347/191
(58) Field of Search ..... 347/191, 180, 347/184, 189, 194, 195; 219/484

(56) References Cited

U.S. PATENT DOCUMENTS

| | | | | |
|---|---|---|---|---|
| 4,887,092 A | | 12/1989 | Pekruhn et al. | 347/223 |
| 5,339,099 A | | 8/1994 | Nureki et al. | 347/180 |
| 5,548,688 A | * | 8/1996 | Wiklof et al. | 347/180 |
| 5,623,297 A | | 4/1997 | Austin et al. | 347/194 |
| 5,912,693 A | * | 6/1999 | Katsuma et al. | 347/191 |
| 6,069,643 A | * | 5/2000 | Yoshida et al. | 347/180 |

FOREIGN PATENT DOCUMENTS

| | | |
|---|---|---|
| EP | 0 716 927 A2 | 6/1996 |
| JP | 8-90818 | 4/1996 |
| JP | 8-90821 | 4/1996 |

* cited by examiner

*Primary Examiner*—Lamson Nguyen
*Assistant Examiner*—K. Feggins
(74) *Attorney, Agent, or Firm*—Brinks Hofer Gilson & Lione

(57) ABSTRACT

A line thermal printer is disclosed in which a plurality of heating elements are subjected to a divided energization process to energize the heating elements by dividing an energization process into a plurality of portions. The line printer includes a controller, including a correction factor table which stores correction factors that have been previously computed using a previously provided exponential functional formula, for performing a controlling operation so that the energization of the heating elements is carried out in accordance with an energization time that has been obtained by a correction factor corresponding to a measured temperature of each of the heating elements, obtained from the correction factor table. The temperature loss caused by dividing the energization process of each of the heating elements, disposed at the line thermal head, is easily and properly corrected.

2 Claims, 6 Drawing Sheets

LINE THERMAL PRINTER AND ENERGIZATION CONTROLLING METHOD

BACKGROUND OF THE INVENTION

1. Field of the Invention

The present invention relates to a line thermal printer and an energization controlling method thereof. More particularly, the present invention relates to a line thermal printer which makes it possible to perform a controlling operation so that a divided energization process is carried out by easily and properly correcting the temperature loss of heating elements caused by dividing the time of energization with respect to each of the heating elements; and an energization controlling method thereof.

2. Description of the Related Art

Hitherto, there has been known a line thermal printer in which a line thermal head with a length allowing it to oppose the range of printing of a recording medium in a widthwise direction thereof is brought into contact with a platen roller through the recording medium, and, while, in this state of contact, the recording medium is transported as a result of rotationally driving the platen roller, a plurality of heating elements of the line thermal head are selectively driven based on recording information, and generate heat, thereby recording a desired image or the like. The line thermal printer carries out a recording operation by, for example, using a thermosensible paper as a recording medium, and applying heat to the thermosensible paper, or using an ink film, such as an ink ribbon or an ink sheet, and applying heat to the ink film in order to transfer the ink of the ink film onto a recording medium.

The line thermal head of this type of line thermal printer comprises a very large number of heating elements arranged in rows in a direction perpendicular to the direction in which the recording medium is transported. Therefore, when all of the heating elements are energized and driven at the same time, a large drive circuit is required. As a result, the supply power becomes large, so that the heating elements cannot be driven using a battery.

For this reason, there has hitherto been used an energization controlling method which makes it possible to reduce the size of the driving circuit and to drive the heating elements using a battery with a small capacity by energizing every several number of heating elements by dividing the energization process in order to reduce the number of heating elements that are energized at the same time, thereby reducing the amount of applied electrical power.

In the line thermal printer using this type of energization controlling method used to divide the energization process, when a recording operation is being performed on a recording medium, there are times when the heating elements are energized and times when they are not energized. Therefore, when they are not being energized, the heat that has been generated due to the energization of the heating elements that has been previously carried out is radiated, thereby reducing the temperature of the heating elements that are not being energized. In order to decrease the size of the driving circuit and to decrease the amount of applied electrical power, the number of divisions of the energization process with respect to the heating elements must be increased to a certain extent. However, increasing the number of divisions of the energization process with respect to the heating elements causes the time during which the heating elements are energized to be longer than the time during which they are not energized, so that the temperature of the heating elements is reduced even more. In this case, even when the thermal elements are subsequently energized, in performing a recording operation on a recording medium, the temperature may not rise high enough to a recording allowing temperature in order for the heating elements to cause a thermosensible paper to be colored or to cause the ink of an ink film to be transferred onto the recording medium. In that case, the problem that a proper image or the like cannot be recorded on the recording medium arises.

Accordingly, in order for the temperature of each of the heating elements to reach a recording allowing temperature, and a proper recording operation to be performed on the recording medium, it has been necessary to correct the temperature of each of the heating elements.

Here, in correcting the temperature of each of the heating elements, when the numbers of divisions of the energization process with respect to each of the heating elements are different, the times during which energization is not carried out differ, so that heat losses of the heating elements when the next energization of each of the heating elements is carried out differ. Therefore, the temperature of each of the heating elements must be corrected in accordance with the number of divisions of the energization process. Consequently, in correcting the temperatures of the heating elements that differ in accordance with the number of divisions of the energization process, either separate correction factors are provided or correction factors are calculated using a linear functional formula as illustrated in FIG. 6. Here, the correction factor is expressed in accordance with the number of divisions of the energization time required for the temperature of each of the thermal elements to reach the recording allowing temperature.

However, providing separate correction factors that differ in accordance with the number of divisions of the energization process is troublesome because it requires confirmation of the correction factors in accordance with the number of divisions of the energization process.

Through research, the applicant has found out that changes in the temperature of a heating element can be expressed by an exponential functional formula, so that the correction factor used for correcting the temperature loss of the heating element caused by dividing the energization process can be expressed by an exponential functional formula. Therefore, since, when a correction factor is calculated using a linear functional formula, an error occurs between the correction factor and the energization time required for the temperature of each of the heating elements to reach the recording allowing temperature, the problem that a proper recording operation cannot be carried out on a recording medium arises. In addition, in subjecting the heating elements to a divided energization process, the temperature of each of the heating elements and the energization time required for the temperature of each of the heating elements to reach the recording allowing temperature are different in accordance with high and low applied electrical power values. Therefore, since the temperature losses of the heating elements by the time the next energization process is carried out are different, separate correction factors also need to be provided in accordance with high and low applied electrical power values, making it troublesome to provide the correction factors.

SUMMARY OF THE INVENTION

Accordingly, in view of the above-described problems, it is an object of the present invention to provide a line thermal printer which makes it possible to perform a controlling operation so that a divided energization process is carried out by easily and properly correcting the temperature losses of heating elements caused by dividing the energization process. It is another object of the present invention to provide an energization controlling method of the line thermal printer.

To this end, according to a first aspect of the present invention, there is provided a line thermal printer in which a plurality of heating elements are disposed at a line thermal head, with the plurality of heating elements being subjected to a divided energization process in order to energize every several number of heating elements by dividing an energization process into a plurality of portions. The line thermal printer comprises controlling means for performing a controlling operation so that the energization of the heating elements is carried out in accordance with an energization time that has been obtained based on a correction factor that has been computed using an exponential functional formula previously provided based on a measured temperature of each of the heating elements.

According to the first aspect, since the correction factor is calculated by the previously provided exponential functional formula, it is not necessary to confirm and to provide the correction factor in accordance with the number of divisions of the energization process and in accordance with high and low electrical power values, so that it is not troublesome to determine the correction factor. In addition, a more accurate correction factor can be determined compared to when the correction factor is computed using a linear functional formula.

According to a second aspect of the present invention, there is provided a line thermal printer in which a plurality of heating elements are disposed at a line thermal head, with the plurality of heating elements being subjected to a divided energization process in order to energize every several number of heating elements by dividing an energization process into a plurality of portions. The line thermal printer comprises controlling means, including a correction factor table which stores correction factors that have been previously computed using a previously provided exponential functional formula, for performing a controlling operation so that the energization of the heating elements is carried out in accordance with an energization time that has been obtained by a correction factor corresponding to a measured temperature of each of the heating elements, obtained from the correction factor table.

According to the second aspect, since the energization time is obtained from the correction factor table which stores the correction factors previously computed using the previously provided exponential functional formula, it is no longer necessary to provide time to compute the correction factor using the exponential functional formula at the controlling means. Therefore, it is possible to easily and properly provide the correction factor, and to quickly provide the correction factor at the controlling means.

According to a third aspect of the present invention, there is provided a method of controlling an energization process in which a controlling operation is carried out so that a plurality of heating elements of a line thermal head are subjected to a divided energization process in order to energize every several number of heating elements by dividing the energization process into a plurality of portions. In the method, a temperature of each of the heating elements is measured, a correction factor is computed using an exponential functional formula that has been previously provided based on the measured temperature of each of the heating elements, and an, energization time is determined based on the computed correction factor in order to subject the heating elements to the divided energization process in accordance with the determined energization time.

According to the third aspect, since the correction factor is calculated by the previously provided exponential functional formula, it is not necessary to confirm and to provide the correction factor in accordance with the number of divisions of the energization process and in accordance with high and low electrical power values, so that it is not troublesome to determine the correction factor. In addition, a more accurate correction factor can be determined compared to when the correction factor is computed using a linear functional formula.

According to a fourth aspect of the present invention, there is provided a method of controlling an energization process in which a controlling operation is carried out so that a plurality of heating elements of a line thermal head are subjected to a divided energization process in order to energize every several number of heating elements by dividing the energization process into a plurality of portions. In the method, a temperature of each of the heating elements is measured, the measured temperature of each of the heating elements and a correction factor that corresponds to the measured temperature of each of the heating elements are obtained from a correction factor table which stores the correction factors that have been previously computed by a previously provided exponential functional formula, and an energization time that corresponds to the obtained correction factor is determined in order to subject the heating elements to the divided energization process for a length of time equal to the determined energization time.

According to the fourth aspect, since the energization time is obtained from the correction factor table that stores the correction factors that have been previously calculated using the previously provided exponential functional formula, it is no longer necessary to provide time for calculating the correction factor using the exponential functional formula when the controlling operation is carried out. Therefore, it is possible to easily and properly provide the correction factor, and to quickly provide the correction factor during the controlling operation.

DESCRIPTION OF THE PREFERRED EMBODIMENT

Hereunder, a description of a preferred embodiment of the present invention will be given with reference to FIGS. 1 to 5.

Figure 1:
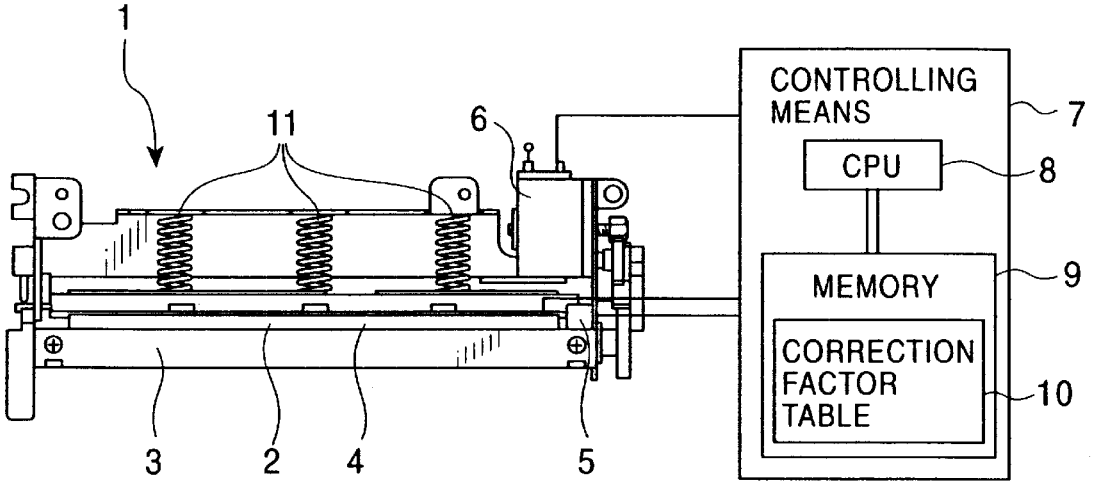
FIG. 1 illustrates a line thermal printer of the present invention.

FIG. 1 illustrates an embodiment of a line thermal printer in accordance with the present invention. In a line thermal printer 1, a line thermal head 2 is disposed so as to oppose a platen roller 3. The line thermal head 2 has a length which allows it to oppose the range of printing of a thermosensible paper in a widthwise direction thereof. The line thermal head 2 comprises a plurality of heating elements 4 that are disposed in rows in a direction which is perpendicular to the direction in which a recording medium is transported. A spring 11 for press-contacting the heating elements 4 of the line thermal head 2 to a thermosensible paper is disposed at the surface of the line thermal head 2 opposite to the surface where the heating elements 4 of the line thermal head 2 are disposed.

A driving motor 6 is mounted at the line thermal printer 1 in order to drive the plate roller 3 and a temperature measuring means 5, such as a thermistor, for measuring a temperature T of each of the heating elements 4. The temperature measuring means 5 and the driving motor 6 are electrically connected to a controlling means 7 for controlling the operation of each part of the line thermal printer 1. At least a CPU (central processing unit) 8 and a memory 9, such as a ROM or RAM, having the proper capacity are disposed in the controlling means 7. In the memory 9 is recorded at least a program used performing a controlling operation so that the heating elements 4 are driven by dividing the energization process with respect to each of the heating elements, so that the heating elements 4 are selectively made to generate heat based on recording information, and so that, for example, the platen roller 3 is rotationally driven.

Here, when an energization time t with respect to each of the heating elements 4 elapses, and energization of the heating elements 4 is no longer carried out, a temperature T of each of the heating elements 4 decreases. At this time, the temperature T of each of the heating elements 4 is:

(Temperature of heating element)={(Quantity of heat applied to heating element)−(Quantity of heat emitted from heating element)}÷(Mass×Specific heat)

Accordingly, the temperature T can be expressed by a first-order linear differential equation. When this equation is solved, the temperature T of each of the heating elements 4 can be expressed by an exponential function. In other words, a temperature change T(t) of each of the heating elements 4 is:

$T(t)=ae^{-bx}$ (where $a$ and $b$ are constants)

Figure 2:
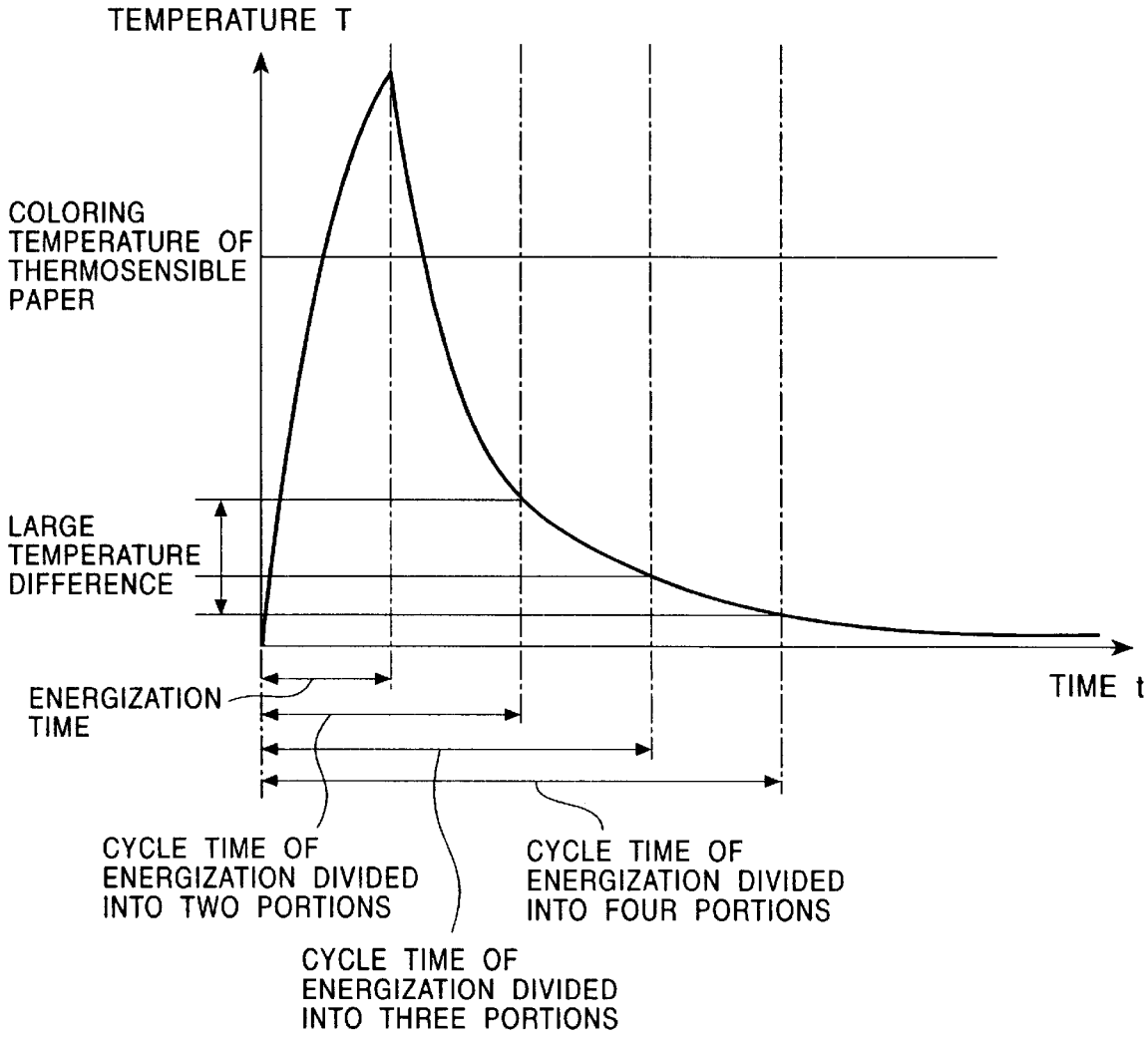
FIG. 2 is a graph showing the changes in temperature of heating elements when the applied electrical power is high.
Figure 3:
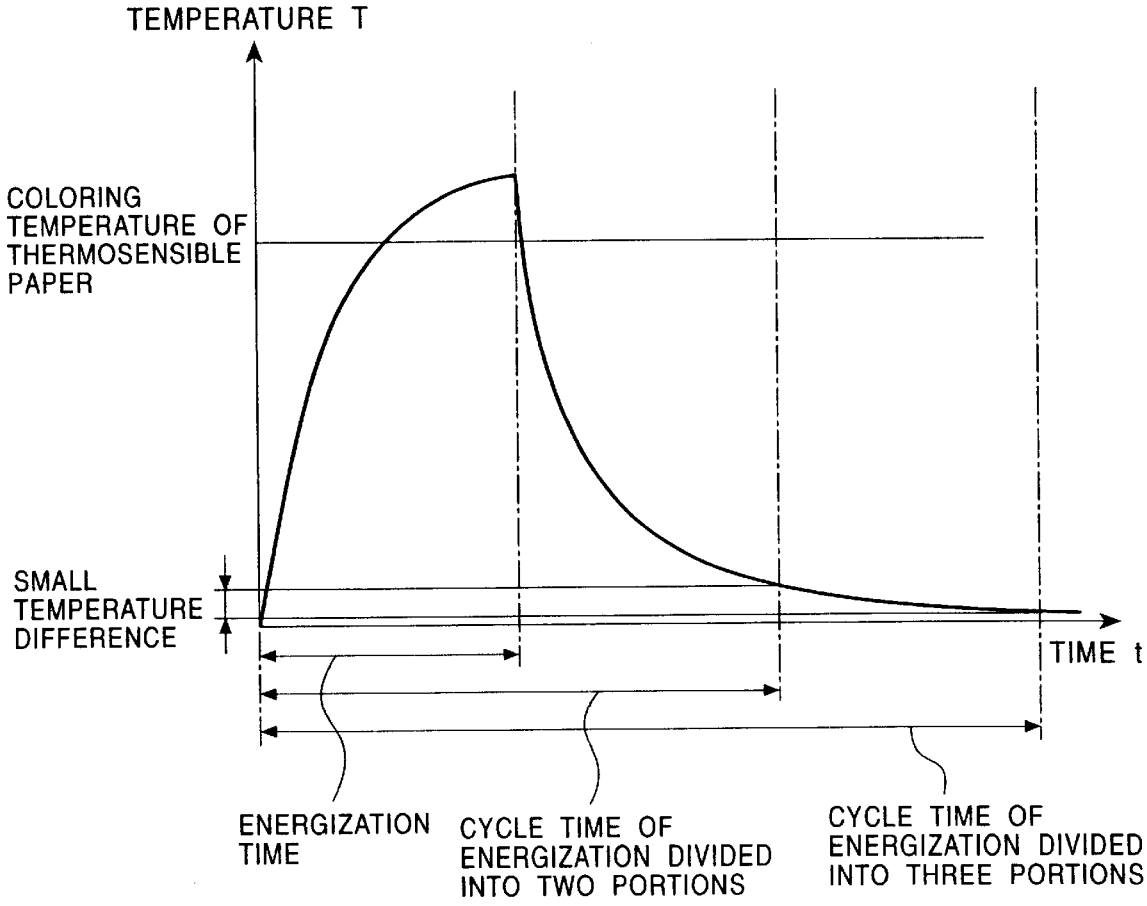
FIG. 3 is a graph showing the changes in temperature of the heating elements when the applied electrical power is low.

Accordingly, the temperature change T(t) can be expressed by this exponential functional formula, so that the relationship between the temperature T and the energization time t can be expressed by the graphs shown in FIGS. 2 and 3.

FIG. 2 shows the relationship between the temperature T and the energization time t when the electrical power applied to the heating elements 4 is high. When the applied electrical power is high, the amount of heat generated by the heating elements 4 is high, so the energization time t required for the temperature of each of the heating elements 4 to reach the recording allowing temperature is short. Since the energization time t cycle is short in addition to the amount of heat generated by the heating elements 4 being large, when the energization process is divided into two portions, the temperature T of each of the heating elements 4 is not reduced very much by the time the next energization process of the heating elements 4. In contrast, in the case where the energization process is divided into four portions, by the time the next energization of the heating elements 4 is carried out, the temperature T of each of the heating elements 4 is reduced to about the same temperature as that when the energization of the heating elements 4 was started. Therefore, there is a large difference between the temperatures T of the heating elements 4 for the cases where the energization process is divided into two portions and where it is divided into four portions.

FIG. 3 shows the relationship between the temperature T and the energization time t when the electrical power applied to the heating elements is low. When the applied electrical power is low, the amount of heat generated by the heating elements 4 is small, so that the energization time t required for the temperature of each of the heating elements 4 to reach the recording allowing temperature is long. Since the energization time t cycle is long in addition to the amount of heat generated by the heating elements 4 being small, in the case where the energization process is divided into two portions, by the time the next energization of the heating elements 4 is carried out, the temperature of each of the heating elements 4 is reduced to about the temperature T that each of them had when the energization of the heating elements 4 was started. In the case where the energization process is divided into four portions, the temperature T of the heating elements 4 when they are subjected to the next energization process is such as not to differ greatly from the corresponding temperature where the energization process is divided into two portions.

Figure 4:
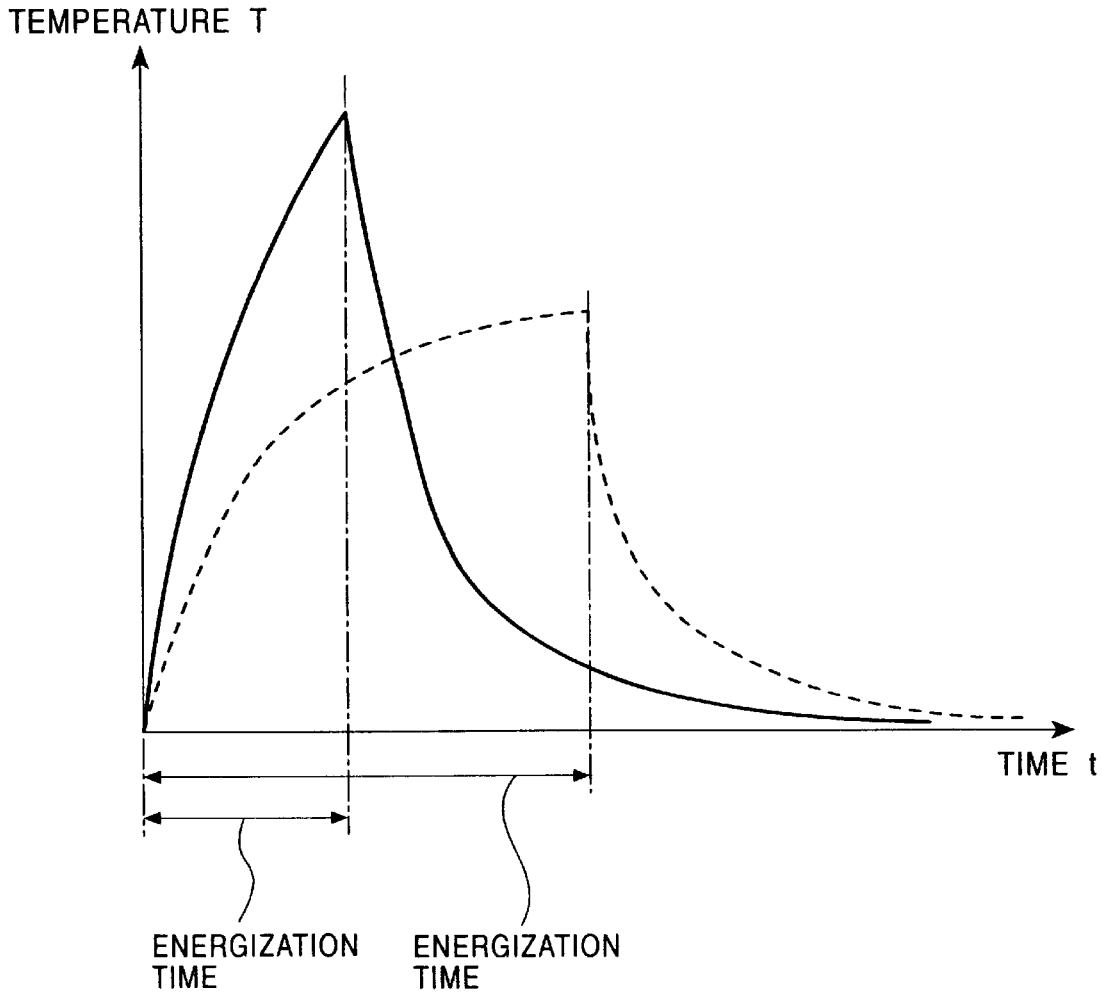
FIG. 4 is a graph showing the differences in the times of energization of the heating elements for high and low applied electrical power values.

Comparing the cases where the applied electrical power is high and where it is low, as shown in FIG. 4, a difference occurs between the energization times required for the temperatures of the heating elements 4 to reach the recording allowing temperature. Therefore, a large difference occurs between the lengths of the energization time cycles when the energization process is divided.

Therefore, the correction factors used for correcting the temperature loss caused by dividing the energization process differ depending upon the number of divisions of the energization process and in accordance with high and low applied electrical power values. A correction factor f in accordance with each number of divisions of the energization process can be expressed by the following exponential functional formula:

$f(n)=a(1-e^{-bn})$ (where $n$ is the number of divisions of the energization process)

Figure 5:
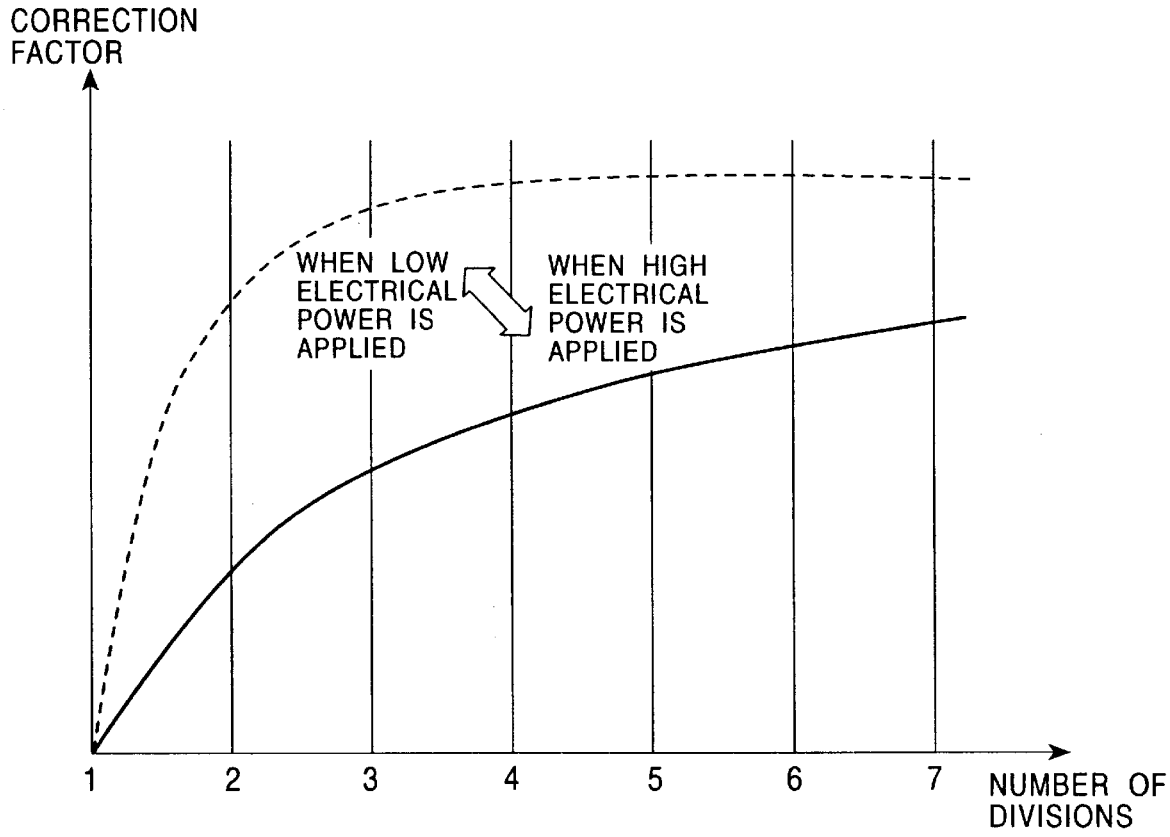
FIG. 5 is a graph showing the correction factor in accordance with the number of divisions of the energization process.
Figure 6:
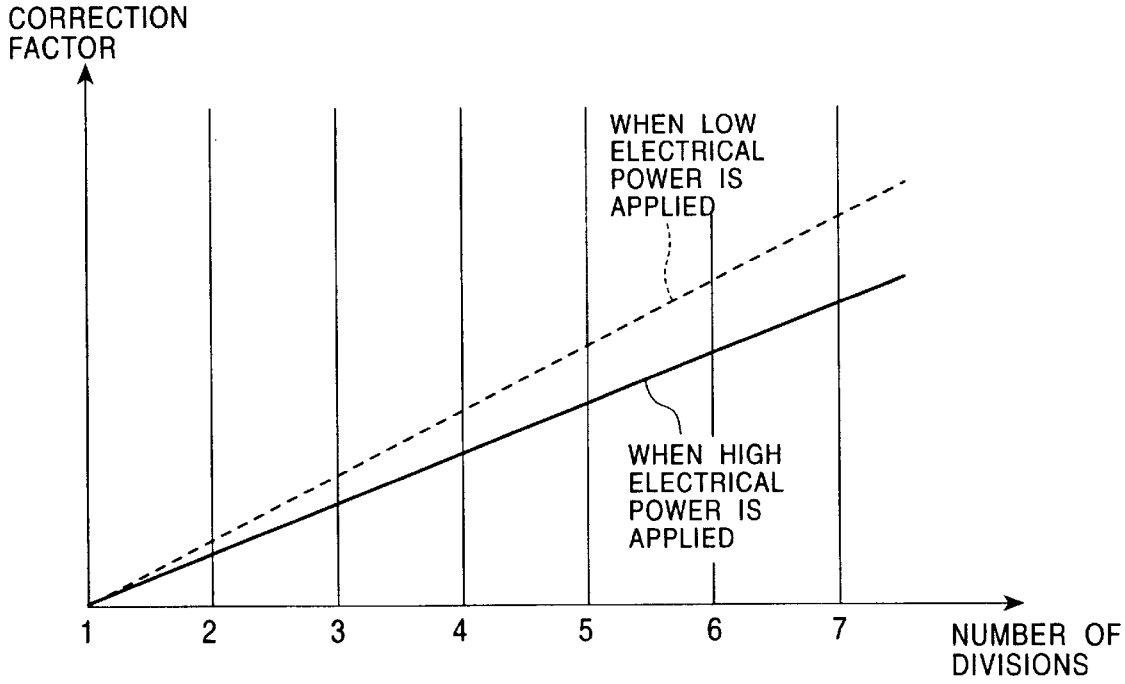
FIG. 6 PRIOR ART
FIG. 6 is a graph showing the correction factor in accordance with the number of divisions of the energization process in a conventional example.

The correction factors f are shown in the graph illustrated in FIG. 5.

Accordingly, there is stored a program used for a controlling operation carried out so that the correction factor based on the temperature T, measured by the temperature measuring means 5, is obtained from the correction factor table 10, and the energization time t in accordance with the obtained correction factor is determined in order to energize each of the heating elements 4.

Then, based on the information sent from the controlling means 7, the driving motor 5 is driven, and, based on the energization time t corresponding to the correction factor, each of the heating elements 4, disposed at the line thermal head 2, is subjected to a divided energization process.

In the embodiment, the energization time t is determined using the correction table 10 which stores the correction factors, previously calculated using the exponential function where temperature T serves as a variable, and the energization times t corresponding to the correction factors. However, the method of obtaining the energization time t is not limited thereto. It may be obtained by successively calculating the correction factor by the previously provided exponential functional formula, and obtaining the energization time t that is in correspondence with the computed correction factor.

The structure of each part of the line thermal printer 1 is similar to that of the conventional line thermal printer, so that a detailed description thereof will not be given below.

A description of the method of controlling the energization of the line thermal printer of the present invention will now be given.

In the line thermal printer 1 of the embodiment, the line thermal head 2 is brought into contact with the platen roller 3 through a thermosensible paper. In this state of contact, while the platen roller 3 is rotationally driven and the thermosensible paper is transported, the plurality of heating elements 4 of the line thermal head 2 are energized. Based on the recording information, the heating elements 4 are selectively driven so as to generate heat in order to cause the thermosensible paper to get colored, thereby making it possible to record a desired image or the like.

In the method of controlling the energization with respect to each of the heating elements 4 of the embodiment of the present invention, in order to correct the temperature T which has been lost by dividing the energization process, when the recording information is sent to the CPU 8, disposed in the controlling means 7, the temperature of each of the heating elements 4 is measured by the temperature measuring means 5, and the information regarding the measured temperature T of each of the heating elements 4 is sent to the memory 9, disposed in the controlling means 7. Then, using the correction factor table 10, stored in the memory 9, the energization time t corresponding to the temperature T of each of the heating elements 4, measured by the temperature measuring means 5, is determined, and the information concerning the determined energization time t is sent to the driving motor through the CPU 8. Based on this information, while the thermosensible paper is transported by rotationally driving the platen roller 3, the driving motor 6 causes each of the heating elements 4 to be subjected to a divided energization process and to be driven. In addition, it is controlled so that, based on the desired recording information, the heating elements are selectively made to produce heat for driving.

Accordingly, in the embodiment, by computing the correction value using the previously provided exponential functional formula, the energization time t required for the temperature of each of the heating elements 4 to reach the recording allowing temperature can be easily determined in accordance with the number of divisions of the energization process, and, unlike the conventional method of correcting the temperature of each of the heating elements 4 using a linear functional formula, proper temperature corrections can be carried out. As a result, the present invention is effective in making it possible to record a proper image or the like on a thermosensible paper. In addition, since the correction factor is obtained from the correction factor table 10 which stores the correction values previously computed by the previously provided exponential functional formula, it is not necessary to compute the correction factor using the exponential functional formula during the controlling operation, thereby making it possible to quickly provide the energization time t that is in correspondence with the correction factor at the controlling means 7.

The present invention is not limited to the above-described embodiment, so that various modifications can be made as necessary.

For example, although, in the above-described embodiment, the recording is described as being carried out using a thermosensible paper as a recording medium, the recording may be carried out by transferring the ink of an ink film, such as an ink sheet or an ink ribbon, onto an ordinary sheet.

As can be understood from the foregoing description, the line thermal printer of the present invention comprises controlling means for performing a controlling operation so that the energization of the heating elements is carried out in accordance with an energization time that has been obtained based on a correction factor that has been computed using an exponential functional formula previously provided based on a measured temperature of each of the heating elements. Therefore, it is not necessary to confirm and to provide a correction factor in accordance with the number of divisions of the energization process and high and low applied electrical power values, so that it is not troublesome to provide the correction factor. In addition, the present invention is effective in that a more accurate correction factor can be provided than that computed using a linear functional formula. This makes it possible to record a proper image or the like on the recording medium.

Another line thermal printer of the present invention comprises controlling means, including a correction factor table which stores correction factors that have been previously computed using a previously provided exponential functional formula, for performing a controlling operation so that the energization of the heating elements is carried out in accordance with an energization time that has been obtained by a correction factor corresponding to a measured temperature of each of the heating elements, obtained from the correction factor table. Therefore, it is no longer necessary to provide time for calculating the correction factor using the exponential functional formula at the controlling means. Therefore, it is possible to easily and properly provide the correction factor, and to quickly provide the correction factor at the controlling means. Consequently, it is possible to properly and quickly record an image or the like on a recording medium.

A method of controlling the energization of a line thermal printer of the present invention is such that a temperature of each of the heating elements is measured, a correction factor is computed using an exponential functional formula that has been previously provided based on the measured temperature of each of the heating elements, and an energization time is determined based on the computed correction factor in order to subject the heating elements to the divided energization process in accordance with the determined energization time. Therefore, it is not necessary to confirm and to provide a correction factor in accordance with the number of divisions of the energization process and high and low applied electrical power values, so that it is not troublesome to provide the correction factor. In addition, the present invention is effective in that a more accurate correction factor can be provided than that computed using a linear functional formula. This makes it possible to record a proper image or the like on the recording medium.

Another method of controlling the energization of a line thermal printer of the present invention is such that a temperature of each of the heating elements is measured, the measured temperature of each of the heating elements and a correction factor that corresponds to the measured temperature of each of the heating elements are obtained from a correction factor table which stores the correction factors that have been previously computed by a previously provided exponential functional formula, and an energization time that corresponds to the obtained correction factor is determined in order to subject the heating elements to the divided energization process for a length of time equal to the determined energization time. Therefore, it is no longer necessary to provide time for calculating the correction factor using the exponential functional formula during the controlling operation. Therefore, it is possible to easily and properly provide the correction factor, and to quickly provide the correction factor during the controlling operation. Consequently, it is possible to properly and quickly record an image or the like on a recording medium.

What is claimed is:

1. A line thermal printer in which a plurality of heating elements are disposed at a line thermal head, with the plurality of heating elements being subjected to a divided energization process to energize the heating elements by dividing an energization process into a plurality of portions, the line thermal printer comprising:

a controller, including a correction factor table which stores correction factors that have been previously computed using a previously provided exponential functional formula in accordance with the number of divisions of the energization process, to perform a controlling operation so that the energization of the heating elements is carried out in accordance with an energization time that has been obtained by a correction factor corresponding to a measured temperature of each of the heating elements, obtained from the correction factor table.

2. A method of controlling an energization process of a line thermal printer in which a controlling operation is carried out, the method comprising:

subjecting a plurality of heating elements of the line thermal head to a divided energization process;

energizing the heating elements by dividing the energization process into a plurality of portions;

measuring a temperature of each of the heating elements;

obtaining a correction factor that corresponds to the measured temperature of each of the heating elements from a correction factor table which stores the correction factors as correction factors that have been previously computed by a previously provided exponential functional formula in accordance with the number of divisions of the energization process; and determining an energization time that corresponds to the obtained correction factor to subject the heating elements to the divided energization process for a length of time equal to the determined energization time.

* * * * *